US010842345B2

(12) United States Patent
Rittner et al.

(10) Patent No.: US 10,842,345 B2
(45) Date of Patent: Nov. 24, 2020

(54) LIFTING DEVICE AND DISHWASHER

(71) Applicant: BSH Hausgeräte GmbH, Munich (DE)

(72) Inventors: Martin Rittner, Welden (DE); Ersin Isbilen, Lauingen (DE); Thomas Steck, Holzheim (DE)

(73) Assignee: BSH Hausgeräte GmbH, Munich (DE)

( * ) Notice: Subject to any disclaimer, the term of this patent is extended or adjusted under 35 U.S.C. 154(b) by 9 days.

(21) Appl. No.: 15/735,209

(22) PCT Filed: May 27, 2016

(86) PCT No.: PCT/EP2016/062058
§ 371 (c)(1),
(2) Date: Dec. 11, 2017

(87) PCT Pub. No.: WO2016/206912
PCT Pub. Date: Dec. 29, 2016

(65) Prior Publication Data

US 2018/0168429 A1 Jun. 21, 2018

(30) Foreign Application Priority Data

Jun. 22, 2015 (DE) ..... 10 2015 211 495

(51) Int. Cl.
*A47L 15/50* (2006.01)
*A47B 88/90* (2017.01)

(52) U.S. Cl.
CPC ..... *A47L 15/506* (2013.01); *A47L 15/507* (2013.01); *A47B 2088/901* (2017.01); *A47L 2401/34* (2013.01)

(58) Field of Classification Search
CPC ..... A47L 15/46; A47L 15/506; A47L 15/507; A47L 2401/34; A47L 2501/36;
(Continued)

(56) References Cited

U.S. PATENT DOCUMENTS 2,486,564 A * 11/1949 Kamin ..... F24C 15/162 126/339
4,163,929 A * 8/1979 Janu ..... A61B 6/0457 318/628
(Continued)

FOREIGN PATENT DOCUMENTS

AT 381622 B 11/1986
DE 102006007329 A1 * 8/2007 ..... A47L 15/0049
(Continued)

OTHER PUBLICATIONS

International Search Report PCT/EP2016/062058 dated Jun. 27, 2016.
National Search Report DE 10 2015 211 495.3 dated Aug. 18, 2016.

*Primary Examiner* — Hiwot E Tefera
(74) *Attorney, Agent, or Firm* — Michael E. Tschupp; Andre Pallapies; Brandon G. Braun

(57) ABSTRACT

A lifting device for a dish receptacle of a dishwasher, in particular a household dishwasher, includes a drive facility configured to assist a manual raising or lowering of the dish receptacle between a start position and an end position by applying a supporting force. A control facility activates the drive facility as a function of a manual actuation force when the dish receptacle is raised or lowered manually and a sensor facility is provided to detect the manual actuation force. A transmission facility transmits the manual actuation force from a handle of the dish receptacle to the sensor facility.

17 Claims, 6 Drawing Sheets

(58) Field of Classification Search
CPC ..... A47L 15/404; A47B 96/07; A47B 46/005; A47B 2088/901; F24C 15/168; F24C 15/162
See application file for complete search history.

(56) References Cited

U.S. PATENT DOCUMENTS

| | | | | | |
|---|---|---|---|---|---|
| 4,342,369 | A * | 8/1982 | Ransom | A47L 9/325 | 15/340.2 |
| 4,637,373 | A * | 1/1987 | Shirai | F24C 15/162 | 126/19 R |
| 5,339,916 | A * | 8/1994 | Louis | A47L 5/28 | 15/340.2 |
| 5,971,513 | A * | 10/1999 | Cassalia | A47L 15/506 | 312/272 |
| 6,247,771 | B1 * | 6/2001 | Miller | A47L 15/506 | 312/272 |
| 7,628,461 | B2 * | 12/2009 | Carden | F25D 25/025 | 312/310 |
| 7,731,805 | B2 * | 6/2010 | Banta | A47L 15/506 | 134/56 D |
| 8,231,190 | B2 * | 7/2012 | Ertz | F25D 25/025 | 312/323 |
| 8,303,053 | B2 * | 11/2012 | Bond | A47L 15/506 | 312/319.2 |
| 9,004,455 | B2 * | 4/2015 | Falcon | A47B 51/00 | 254/133 R |
| 9,420,882 | B2 * | 8/2016 | Garcia | A47B 46/005 | |
| 9,895,046 | B1 * | 2/2018 | Wilson | A47L 15/506 | |
| 9,993,072 | B2 * | 6/2018 | Azkue | A47B 46/005 | |
| 2003/0042825 | A1 | 3/2003 | Welch et al. | | |
| 2004/0163687 | A1 * | 8/2004 | Son | A47L 15/506 | 134/58 D |
| 2004/0244825 | A1 | 12/2004 | Ashton | | |
| 2006/0022564 | A1 * | 2/2006 | Oh | A47B 51/00 | 312/402 |
| 2006/0043848 | A1 * | 3/2006 | Jeong | A47B 46/00 | 312/310 |
| 2008/0111039 | A1 * | 5/2008 | Papendieck | F16G 11/12 | 248/281.11 |
| 2008/0129168 | A1 | 6/2008 | Banta et al. | | |
| 2009/0009040 | A1 | 1/2009 | Dellby et al. | | |
| 2010/0045152 | A1 | 2/2010 | Bond et al. | | |
| 2012/0074080 | A1 * | 3/2012 | Garcia | A47B 46/005 | 211/41.9 |
| 2012/0111366 | A1 | 5/2012 | Baldwin et al. | | |
| 2015/0002005 | A1 * | 1/2015 | Park | A47L 15/506 | 312/228.1 |
| 2015/0305493 | A1 | 10/2015 | Garcia et al. | | |
| 2016/0120722 | A1 * | 5/2016 | Mueller | A61G 3/063 | 187/200 |
| 2016/0309982 | A1 * | 10/2016 | Gerstner | A47L 15/506 | |
| 2017/0027413 | A1 * | 2/2017 | Gerstner | A47L 15/506 | |
| 2017/0273538 | A1 * | 9/2017 | Kulkarni | A47L 15/506 | |

FOREIGN PATENT DOCUMENTS

| | | | | |
|---|---|---|---|---|
| DE | 102013226910 | A1 * | 6/2015 | A47L 15/506 |
| DE | 102015211492 | A1 * | 12/2016 | A47L 15/506 |
| EP | 0147815 | A2 * | 7/1985 | A47L 15/506 |
| WO | WO-2015185631 | A1 * | 12/2015 | A47L 15/507 |

* cited by examiner

LIFTING DEVICE AND DISHWASHER

CROSS-REFERENCES TO RELATED APPLICATIONS

This application is the U.S. National Stage of International Application No. PCT/EP2016/062058, filed May 27, 2016, which designated the United States and has been published as International Publication No. WO 2016/206912 A1 and which claims the priority of German Patent Application, Serial No. 10 2015 211 495.3, filed Jun. 22, 2015, pursuant to 35 U.S.C. 119(a)-(d).

BACKGROUND OF THE INVENTION

The present invention relates to a lifting device for a dish receptacle of a dishwasher and a dishwasher.

A dishwasher has a wash container and at least one dish receptacle that can be moved into and out of the wash container. The dishwasher can have a number of dish receptacles arranged one above the other, for example a lower rack, an upper rack or a flatware rack. As the lower rack is arranged close to a base of the wash container, the user has to kneel or bend to reach the lower rack in order to load and unload it.

WO 2005/104924 A1 describes a lifting device for a lower rack of a dishwasher. The lifting device can be used to raise the lower rack from a lower position to an upper position or to lower it from the upper position to the lower position.

BRIEF SUMMARY OF THE INVENTION

With this in mind it is an object of the present invention to provide an improved lifting device.

Accordingly a lifting device for a dish receptacle of a dishwasher, in particular a household dishwasher, is proposed, the lifting device being designed to raise the dish receptacle from a start position to an end position or lower it from the end position to the start position, the lifting device comprising a drive facility, which is designed to assist manual raising or lowering with a supporting force when the dish receptacle is raised or lowered manually, a control facility, which is designed to activate the drive facility as a function of a manual actuation force when the dish receptacle is raised or lowered manually, a sensor facility for detecting the manual actuation force and a transmission facility for transmitting the manual actuation force from a handle of the dish receptacle to the sensor facility.

The transmission facility can be guided along the dish receptacle in the direction of the sensor facility by the handle. This means it is not necessary to attach the sensor facility directly to the dish receptacle. There is also no need for complex radio transmission of handle movement from the handle to the sensor facility. The drive facility can be designed in particular to activate the drive facility in such a manner during manual movement of the dish receptacles that the drive facility assists the manual movement of the dish receptacle with a supporting torque. The dish receptacle is preferably a lower dish receptacle or a lower rack of the dishwasher. An upper dish receptacle or upper rack can be arranged above the lower dish receptacle in a wash container of the dishwasher. Because the drive facility only assists manual movement and does not move the dish receptacle out of or into the wash container independently, unwanted movement, for example unwanted complete removal of the dish receptacle from the wash container, is reliably prevented. This removes the risk of injury to the user. In particular the lifting device is designed to move the lower dish receptacle to the same height as the upper dish receptacle and at the same time in front of the upper dish receptacle.

The lifting device preferably also comprises at least one pivot arm which is fastened in a pivotable manner to the wash container of the dishwasher and to the dish receptacle. Four such pivot arms are preferably assigned to the wash container, being arranged in pairs on each side of the wash container. In particular the pivot arms are arranged in a pivotable manner on a guide facility, to which the dish receptacle is fastened. In particular the drive facility is arranged on the at least one pivot arm. The drive facility preferably has a drive shaft, which is passed through a side wall of the wash container. A suitable sealing apparatus can be provided between the drive shaft and the side wall. The drive shaft is connected to a bearing point of the pivot arm in a rotationally fixed manner. Such a drive facility can preferably be provided on both sides of the dish receptacle. Such a drive facility can optionally be provided on each of the pivot arms.

According to one embodiment the transmission facility comprises a fluidic and/or mechanical transmission means, in particular a fluid line, a control cable, a Bowden cable and/or a bar.

The transmission facility can also comprise a gear mechanism. The transmission facility is preferably designed to transmit movement of the handle to the sensor facility mechanically.

According to a further embodiment the sensor facility is arranged inside or outside a wash container of the dishwasher.

For example the sensor facility can be provided on a side wall of the wash container. The sensor facility can comprise a Hall sensor, a parameter-dependent resistor, a strain gage strip, an optical sensor, a piezo-sensor, an electric switch or the like. A parameter-dependent resistor can also be referred to as a non-linear resistor. The resistance value of the parameter-dependent resistor here is a function of one or more further physical parameters such as the voltage present at the resistor or the like. In particular the correlation between voltage at and current through the resistor cannot be described by the ohmic relationship with a constant resistance value R in the case of non-linear resistors.

According to a further embodiment the sensor facility is designed to detect a movement of the handle resulting from the application of the manual actuation force to the handle.

The sensor facility is designed in particular to detect a movement path of the handle. The application of the manual actuation force causes the handle to move. This movement is detected by the sensor facility. This results in transmission of the manual actuation force into the movement path. The sensor facility outputs a corresponding sensor signal to the control facility, which in turn activates the drive facility as a function of the manual actuation force or the movement path.

According to a further embodiment the control facility is designed to activate the drive facility in such a manner that a movement speed of the dish receptacle is proportional, in particular directly proportional, to the manual actuation force and/or that the supporting force is proportional, in particular directly proportional, to the manual actuation force.

The control facility can be integrated in the drive facility. The drive facility can be or comprise a servomotor. There is preferably a proportionality, in particular a direct proportionality, between the manual actuation force and the supporting force. In other words the greater the manual actuation force, the greater the supporting force applied by the drive facility and the higher the movement speed of the dish receptacle. This enhances ease of use.

According to a further embodiment the lifting device comprises a drag lever, which is designed to stop the dish receptacle as it is raised or lowered, such that, as the dish receptacle is raised or lowered, it is fixed to the drag lever in such a manner that a bearing point of the drag lever provided on the dish receptacle can be pivoted in relation to the dish receptacle and cannot be moved linearly.

In particular, as the dish receptacle is raised or lowered, it is fixed to the drag lever in such a manner that the bearing point of the drag lever provided on the dish receptacle can be pivoted in relation to the dish receptacle but cannot be moved linearly. The drag lever can also be referred to as a control lever. Because the dish receptacle is fixed to the drag lever as it is raised or lowered, the dish receptacle cannot move into the wash container as it is raised or lowered. In particular the dish receptacle can only be moved into and out of the wash container in the start position. This prevents damage to the dishes.

According to a further embodiment the transmission facility or a sensor line of the sensor facility is passed out of the wash container through a bearing point of the drag lever provided on a wash container of the dishwasher. In particular the transmission facility or sensor line can be passed centrally through a bearing pin of the drag lever. This prevents tensile loading on the transmission facility or on the sensor line as the dish receptacle is raised or lowered. There is also no need to compensate for length as the dish receptacle is moved. The sensor facility is coupled to the control facility with the aid of the sensor line, which can be an electric cable.

According to a further embodiment the sensor facility is provided in or on the bearing point of the drag lever provided on the dish receptacle.

The sensor facility can comprise a Hall sensor integrated in the drag lever. The sensor line can be passed along the drag lever.

According to a further embodiment the sensor facility is provided on the drag lever, an actuation element of the sensor facility coupled to the transmission facility being provided on the dish receptacle.

The actuation element can be such that it can be moved rotationally or linearly. A deflection facility can be provided, which deflects movement of the transmission facility into movement of the actuation element, it being possible for a movement direction of the transmission facility to be different from a movement direction of the actuation element. Because only rotational movement takes place in the bearing point as the dish receptacle is raised and lowered, it is ensured that the sensor facility can only move rotationally relative to the actuation element and not linearly.

According to a further embodiment the sensor facility has a Hall sensor fastened to the drag lever, the actuation element being a magnetic element which is mounted on the dish receptacle in such a manner that it can be moved linearly.

The magnetic element can be a permanent magnet. The sensor facility detects movement of the actuation element. The actuation element can also be dispensable, depending on the type of sensor facility used.

According to a further embodiment the bearing point of the drag lever provided on the dish receptacle has a block mechanism provided on the dish receptacle and a block counter-mechanism provided on the drag lever.

The block counter-mechanism is preferably C-shaped. The block mechanism can be moved into the block counter-mechanism when the dish receptacle is moved out of the wash container. In particular the block counter-mechanism traps the block mechanism when the dish receptacle is moved out of the wash container. For example the sensor facility can be provided on the block counter-mechanism and the actuation element can be provided on the block mechanism.

As the dish receptacle is raised and lowered, the block mechanism and block counter-mechanism only twist in relation to one another. Linear movement of the block mechanism in relation to the block counter-mechanism is in particular not possible when the latter is in the blocking state. This ensures that the actuation element can activate the sensor facility during the entire raising and lowering movement of the dish receptacle. On the other hand, when the dish receptacle is moved into the wash container in the start position and the block mechanism is not engaged with the block counter-mechanism, it ensures that the actuation element does not activate the sensor facility. This means in particular that the drive facility cannot be activated when the dish receptacle is in the pushed in state. This prevents damage to the dishes or the dish receptacle due to unwanted activation of the drive facility.

According to a further embodiment the block mechanism and the block counter-mechanism are designed to be arranged so that they can be rotated into one another when the dish receptacle is moved out of a wash container of the dishwasher linearly in the start position.

In particular the movement of the dish receptacle takes place in the pull-out direction, an end position of the dish receptacle in the pull-out direction corresponding to a state in which the block mechanism and the block counter-mechanism are arranged so that they can be rotated into one another. In particular a stop of the block mechanism on the block counter-mechanism can define the end position of the pull-out direction.

According to a further embodiment the block mechanism and the block counter-mechanism can be moved from a release state, in which the dish receptacle can be moved linearly in relation to the drag lever, to a blocking state, in which the bearing point of the drag lever provided on the dish receptacle can be pivoted in relation to the dish receptacle and cannot be moved linearly.

In the blocking state the drag lever can only be pivoted in relation to the dish receptacle and cannot be moved linearly. In the release state the dish receptacle can be moved linearly in relation to the drag lever. When the dish receptacle is moved out of the wash container, the block mechanism is trapped in the block counter-mechanism.

According to a further embodiment the block mechanism and the block counter-mechanism can be moved from the release state to the blocking state by raising the dish receptacle.

As soon as the dish receptacle is raised slightly from the start position, the block mechanism and the block counter-mechanism are moved from the release state to the blocking state.

A dishwasher, in particular a household dishwasher, with a wash container, a dish receptacle that can be accommodated in the wash container and such a lifting device, is also proposed.

The wash container preferably has a base, a top arranged opposite the base, two side walls, a closable door and a rear wall arranged opposite the door. The wash container is preferably cube-shaped. The wash container can be made of a steel material, in particular sheet steel. One or more parts of the wash container can optionally be made of a plastic material.

Further possible implementations of the lifting device and/or the dishwasher also comprise combinations of features and embodiments described above or in the following in relation to the exemplary embodiments, which are not specifically cited. The person skilled in the art will also add individual aspects to improve or supplement the respective basic form of the lifting device and/or dishwasher.

BRIEF DESCRIPTION OF THE DRAWINGS

Further advantageous configurations and aspects of the lifting device and/or dishwasher are the subject matter of the subclaims and the exemplary embodiments of the lifting device and/or dishwasher described in the following. The lifting device and/or dishwasher is/are described in more detail below based on preferred embodiments with reference to the accompanying figures.

DETAILED DESCRIPTION OF EXEMPLARY EMBODIMENTS OF THE PRESENT INVENTION

Figure 1:
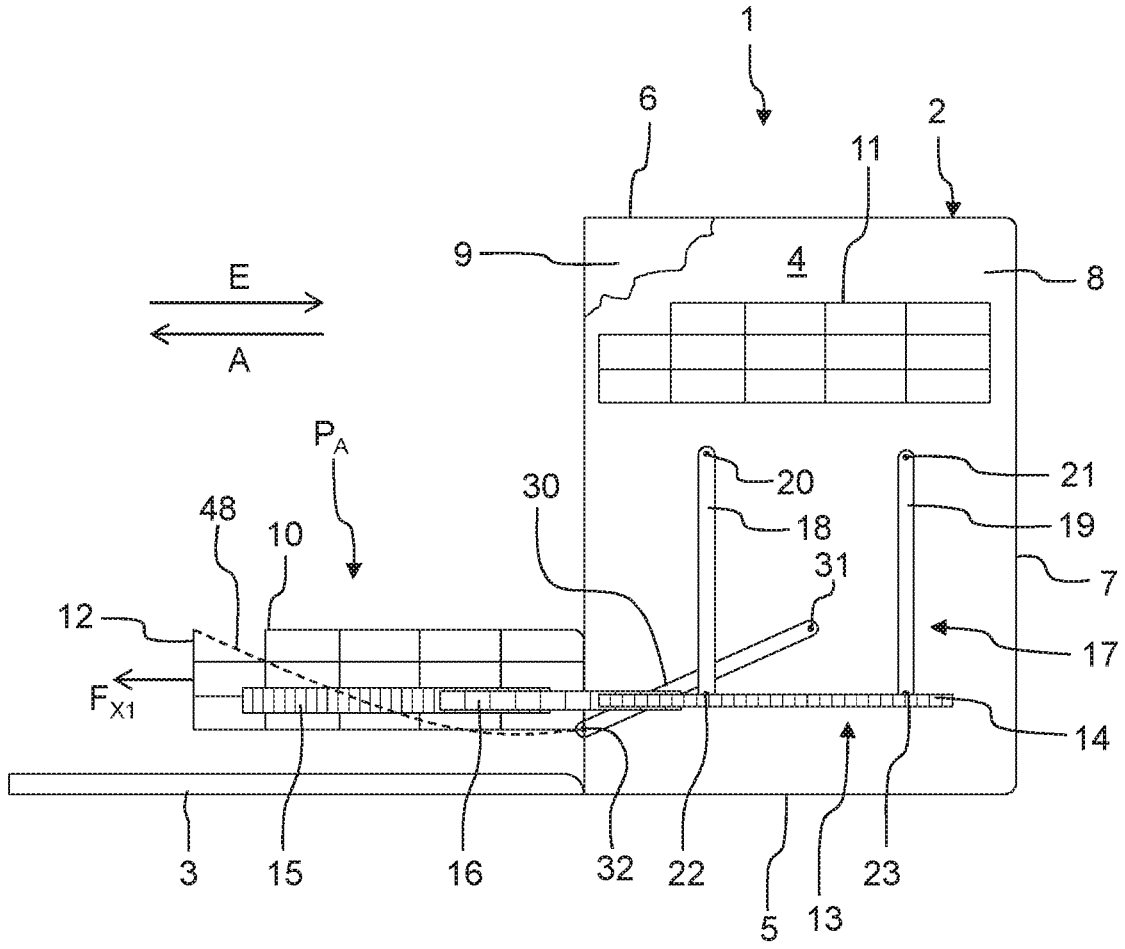
FIG. 1 shows a schematic sectional view of an embodiment of a dishwasher.

Identical elements and those of identical function are shown with the same reference characters in the figures, unless otherwise specified.

Figure 2:
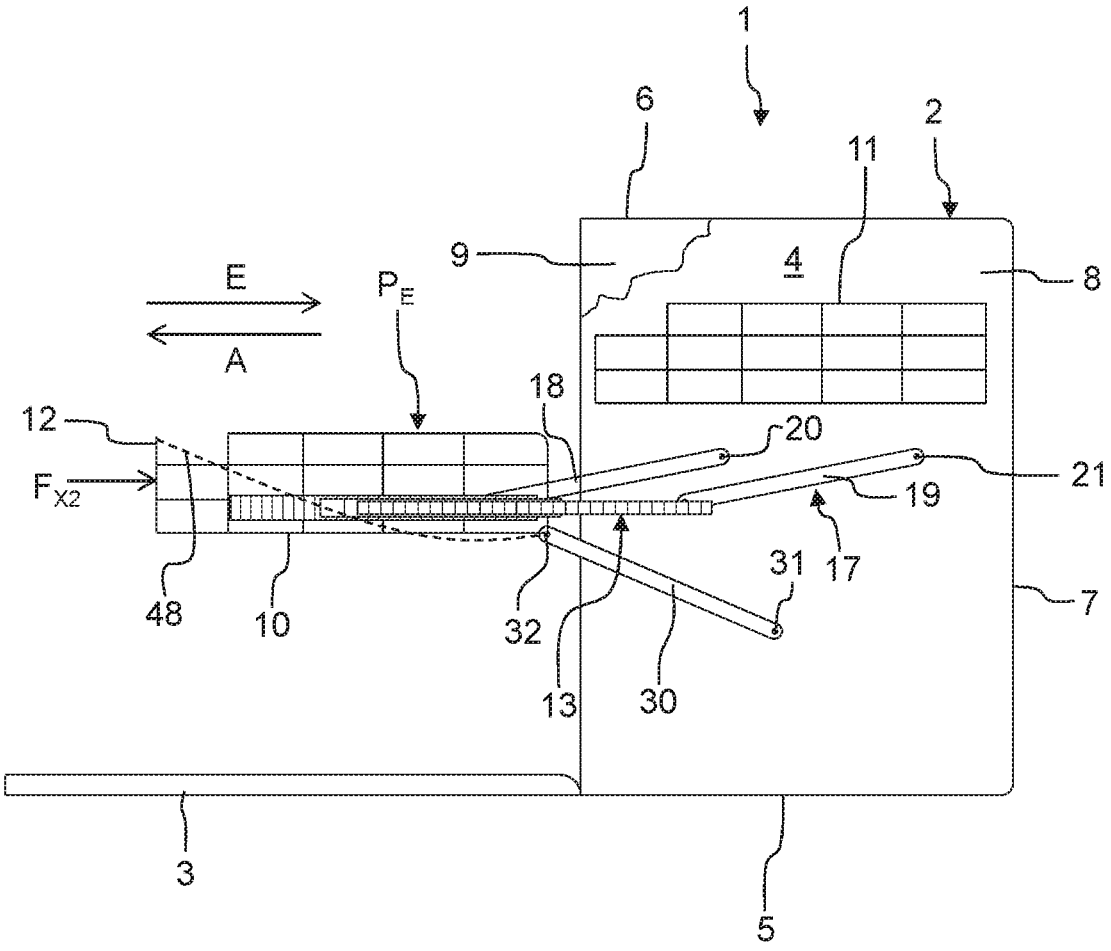
FIG. 2 shows a further schematic sectional view of the dishwasher according to FIG. 1.

FIGS. 1 and 2 each show a schematic sectional view of a preferred embodiment of a dishwasher 1. The dishwasher 1 is preferably a household dishwasher. The dishwasher 1 has a wash container 2, which can be closed by a door 3, in particular in a water-tight manner. To this end a sealing facility can be provided between the door 3 and the wash container 2. The wash container 2 and door 3 can form a wash chamber 4 of the dishwasher 1 for washing dishes. The door 3 is shown in its opened position in FIGS. 1 and 2. The door 3 can be closed or opened by pivoting about a pivot axis provided at a lower end of the door 3.

The wash container 2 has a base 5, a top 6 arranged opposite the base 5 and a rear wall 7 arranged opposite the door 3. The wash container 2 also has two side walls 8, 9 arranged opposite one another. Only part of the side wall 9 is shown in FIGS. 1 and 2. The wash container 2 is preferably cube-shaped. The wash container 2 is preferably made of a metal material, in particular sheet metal. For example the wash container 2 can be made of stainless steel sheet. The base 5 can also be made of a plastic material.

The dishwasher 1 has at least one dish receptacle 10. The dishwasher 1 can preferably have a number of dish receptacles 10, 11. The dish receptacles 10, 11 are preferably arranged one above the other in the wash container 2. The dish receptacle 10 here can be a lower dish receptacle or lower rack and the dish receptacle 11 can be an upper dish receptacle or upper rack. The dishwasher 1 can also have a flatware drawer arranged above the dish receptacle 11. The dish receptacles 10, 11 are preferably box-shaped. Bases and walls of the dish receptacles 10, 11 are latticed. Each dish receptacle 10, 11 can be moved optionally in a push-in direction E into the wash container 2 or out of it counter to the push-in direction E in a pull-out direction A. A handle 12 can be provided on each of the dish receptacles 10, 11.

The dish receptacles 10, 11 can be moved into or out of the wash container 2 with the aid of guide facilities 13. The guide facilities 13 can be configured as what are known as telescopic rails. Each dish receptacle 10, 11 is preferably assigned two such guide facilities 13, arranged on both sides of each dish receptacle 10, 11. The dish receptacles 10, 11 can be suspended from the guide facilities 13. Only one guide facility 13 of the dish receptacle 10 is shown in FIGS. 1 and 2. The guide facility 13 can have a first guide rail 14, a second guide rail 15 and a running rail 16, which is arranged between the first guide rail 14 and the second guide rail 15. The dish receptacle 10 is preferably fastened to the second guide rail 15 and/or suspended therefrom. The running rail 16 can move in relation to the guide rails 14, 15.

The dishwasher 1 also comprises a lifting device 17 for moving the dish receptacle 10 from a start position $P_A$ shown in FIG. 1 to an end position $P_E$ shown in FIG. 2. In particular the lifting device 17 is designed to raise the dish receptacle 10 from the start position $P_A$ to the end position $P_E$ or lower it from the end position $P_E$ to the start position $P_A$. The lifting device 17 comprises at least one first pivot arm 18 and a second pivot arm 19 arranged at a distance from the first pivot arm 18. The pivot arms 18, 19 are each fastened pivotably to one of the side walls 8, 9 of the wash container 2 at bearing points 20, 21. In particular the bearing points 20, 21 are fixed bearings. The bearing point 20 here is arranged at the same height as the bearing point 21 in the vertical direction. The pivot arms 18, 19 are also fastened pivotably to the guide facility 13 and in particular to the first guide rail 14 at bearing points 22, 23. The pivot arms 18, 19 are positioned vertically in FIG. 1. In other words the pivot arms 18, 19 are arranged vertically when the dish receptacle 10 is in the start position $P_A$.

Figure 3:
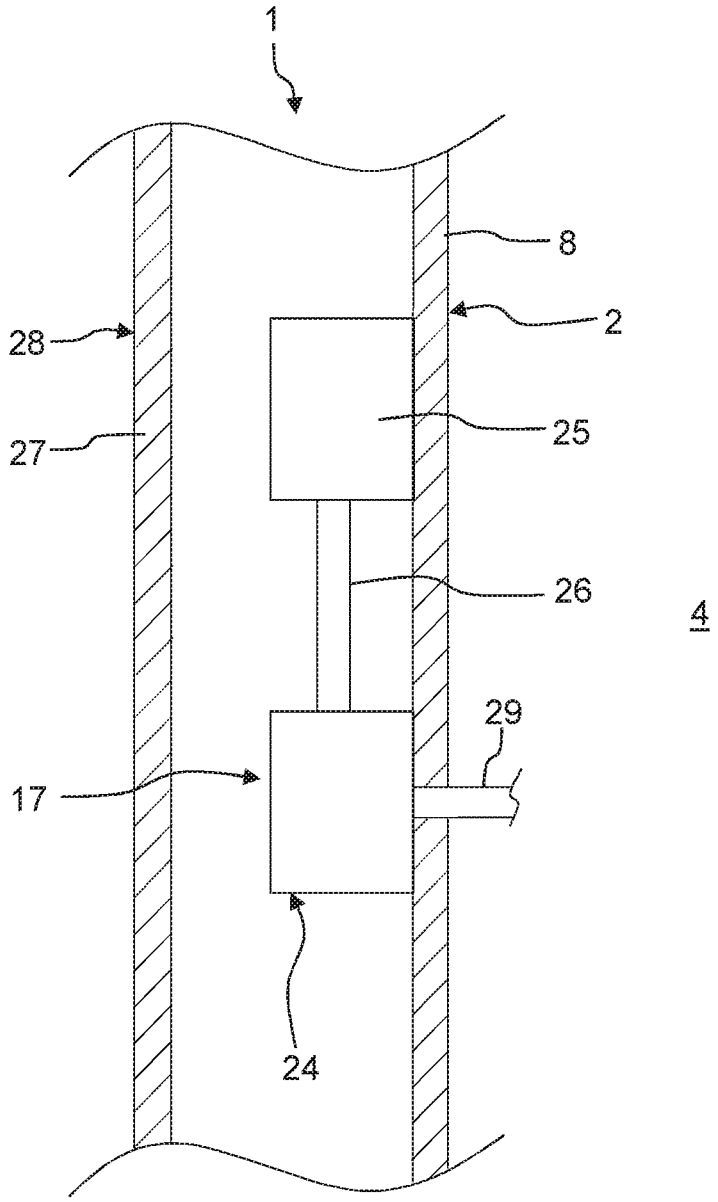
FIG. 3 shows a schematic partial sectional view of the dishwasher according to FIG. 1.

The lifting device 17 also comprises a drive facility 24 as shown in FIG. 3 and a control facility 25, which can be connected to the drive facility 24 by way of a control line 26. The drive facility 24 comprises or is configured as a servomotor. Power can also be supplied to the drive facility 24 by way of the control line 26. The drive facility 24 can alternatively be driven pneumatically or hydraulically. The drive facility 24 and/or control facility 25 is/are arranged in or on a side wall 27 of a housing 28 of the dishwasher 1. As shown in FIG. 3, the drive facility 24 and control facility 25 are positioned between the side wall 8 of the wash container 2 and the side wall 27 of the housing 28 of the dishwasher 1. The control facility 25 can also be integrated in the drive facility 24. This makes the lifting device 17 particularly compact in structure. In particular the control facility 25 operates autarkically. In other words it preferably operates independently of a control facility of the dishwasher 1.

The drive facility 24 comprises a drive shaft 29, which is passed through the side wall 8 of the wash container 2 into the wash chamber 4. A suitable sealing facility can be provided between the drive shaft 29 and the side wall 8. The drive shaft 29 is preferably connected in a rotationally fixed manner to the first pivot arm 18 at the latter's bearing point 20, so that the drive facility 24 can apply a torque to the first pivot arm 18. Alternatively or additionally such a drive facility 24 can also be provided for the second pivot arm 19. Such drive facilities 24 can be provided on both side walls 8, 9 of the wash container. The drive facility 24 is designed to assist the movement of the dish receptacle 10 with a supporting force when said dish receptacle 10 is raised or lowered manually.

Returning to FIGS. 1 and 2, the lifting device 17 also comprises a control lever or drag lever 30. Such a drag lever 30 is preferably provided on both sides of the dish receptacle 10. The drag lever 30 is mounted rotatably on the wash container 2 and in particular on one of the side walls 8, 9 at a bearing point 31. The bearing point 31 here is arranged below the bearing points 20, 21 of the pivot arms 18, 19 in the vertical direction. The drag lever 30 is also mounted on the dish receptacle 10 at a bearing point 32. The drag lever 30 is designed to stop the dish receptacle 10 as it is raised or lowered, such that, as the dish receptacle 10 is raised or lowered, it is fixed to the drag lever 30 in such a manner that the bearing point 32 of the drag lever 30 provided on the dish receptacle 10 can be pivoted in relation to the dish receptacle 10 but cannot be moved linearly. In other words as the dish receptacle 10 is raised or lowered, the bearing point 32 can only be pivoted in relation to the dish receptacle 10. Linear movement of the bearing point 32 in relation to the dish receptacle 10 is not possible. Thus the dish receptacle 10 can only be moved into or out of the wash container 2 in the start position $P_A$.

Figure 4:
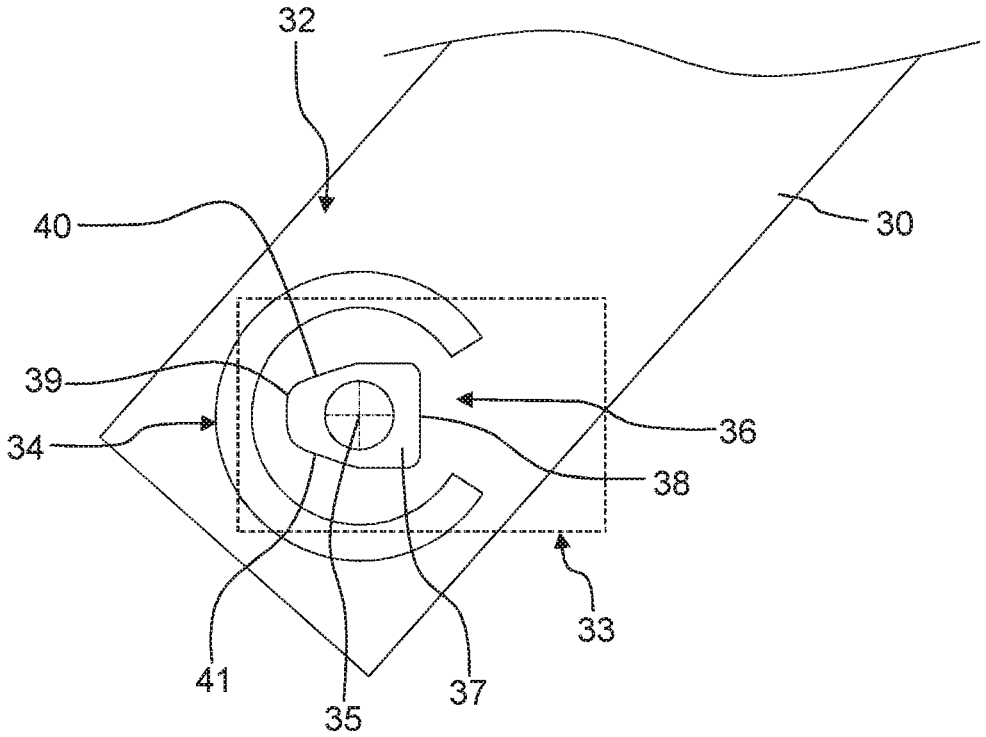
FIG. 4 shows an enlarged schematic view of an embodiment of a drag lever of a lifting device for the dishwasher according to FIG. 1.

FIG. 4 shows an enlarged view of the drag lever 30 with the bearing point 32. The bearing point 32 comprises a block mechanism 33 provided on the dish receptacle 10 and a block counter-mechanism 34 provided on the drag lever 30. The block counter-mechanism 34 is C-shaped and has a radial opening 36 in relation to a rotation axis 35 of the bearing point 32. The block mechanism 33 comprises a pin-shaped block element 37 with a flattened rear face 38 and a rounded front face 39. The pin-shaped block element 37 also comprises angled insertion points 40, 41, which facilitate insertion into the opening 36. In FIG. 4 the pin-shaped block element 37 and the block counter-mechanism 34 are shown in a release state, in which the block mechanism 33 can be twisted in relation to the block counter-mechanism 34 and the block mechanism 33 can be moved linearly in relation to the block counter-mechanism 34, so that the block mechanism 33 can be moved out of and into the block counter-mechanism 34.

In a blocking state (not shown in FIG. 4) the block counter-mechanism 34 can only be pivoted in relation to the block mechanism 33 but cannot be moved out of it. In other words in the blocking state the bearing point 32 of the drag lever 30 can be pivoted in relation to the dish receptacle 10 but cannot be moved linearly. As the dish receptacle 10 is raised from the start position $P_A$ to the end position $P_E$, the C-shaped block counter-mechanism 34 twists in relation to the pin-shaped block element 37 of the block mechanism 33, so that the C-shaped block counter-mechanism 34 encloses the pin-shaped element 37. It can then no longer be moved out of the C-shaped block counter-mechanism 34.

Figure 5:
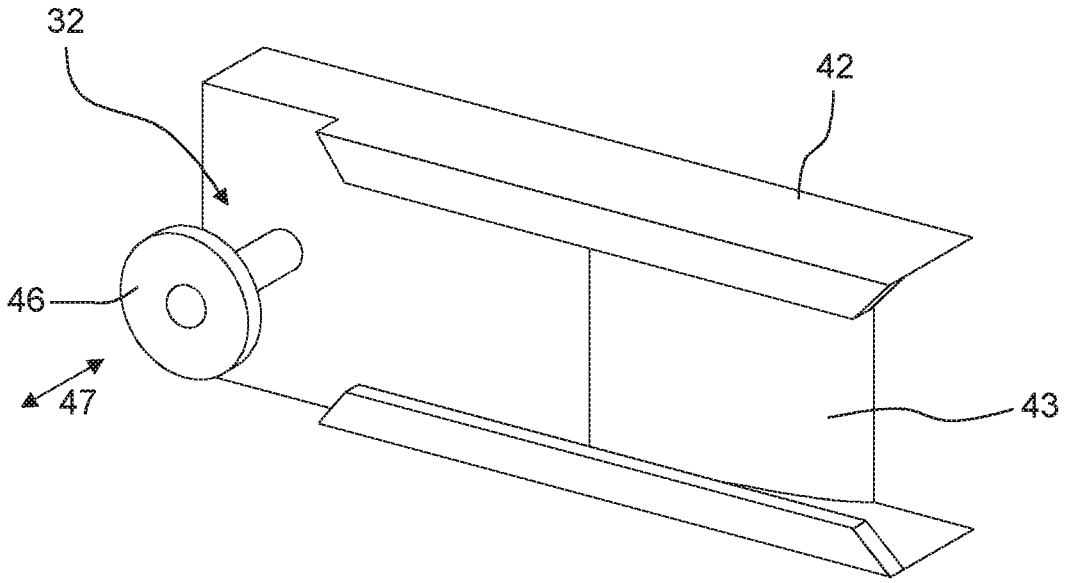
FIG. 5 shows an enlarged schematic view of an embodiment of a bearing point of the drag lever according to FIG. 4.
Figure 6:
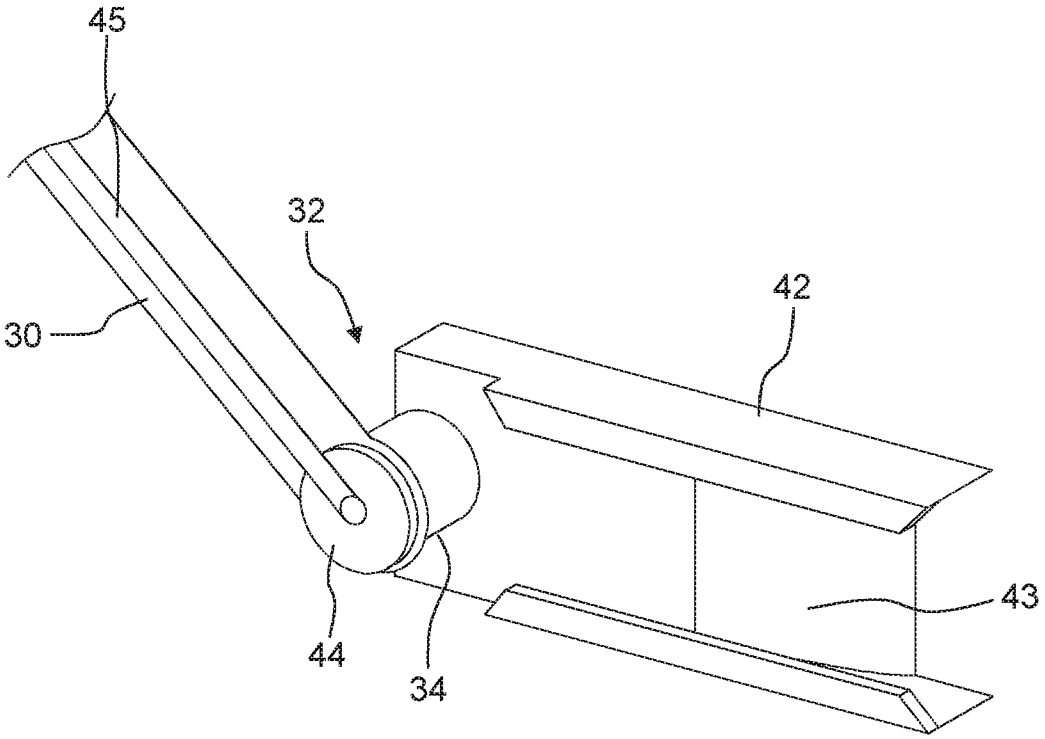
FIG. 6 shows a further enlarged schematic view of the bearing point according to FIG. 5.

FIGS. 5 and 6 each show a perspective view of a connecting element 42 for connecting the drag lever 30 to the dish receptacle 10. The drag lever 30 is not shown in FIG. 5. In the orientation shown in FIGS. 5 and 6 the dish receptacle 10 that is not shown is provided on the rear face of the connecting element 42. The connecting element 42 can be screwed, riveted, clipped or otherwise permanently connected to the dish receptacle 10. One such connecting element 42 is provided on each side of the dish receptacle 10. The connecting element 42 has the bearing point 32. A guide 43 is provided on the front face of the connecting element 42, the drag lever 30 being passed therein when the block mechanism 33 and the block counter-mechanism 34 are in the release state. Thus an end segment of the drag lever 30 facing the bearing point 32 is passed linearly along the connecting element 42 in the release state. The connecting element 42 also comprises the block mechanism 33, which is not shown in FIG. 5 for the sake of simplification. In the orientation in FIG. 5 the block mechanism 33 is provided on the front face. The block mechanism 33 can be configured as a single piece with the connecting element 42.

FIG. 6 also shows a sensor facility 44, which is provided in or on the bearing point 32. The sensor facility 44 can be a Hall sensor for example or can have a Hall sensor. Alternatively the sensor facility 44 can comprise a strain gage strip, an optical sensor, a parameter-dependent resistor, an electric switch or the like. As shown in FIG. 6, the sensor facility 44 is integrated in the drag lever 30. A sensor line 45, for example a cable, is passed along the drag lever 30 and is preferably passed out of the wash container 2 through the bearing point 31 of the drag lever 30. For example the sensor line 45 can be passed centrally through a bearing pin of the drag lever 30 mounted rotatably at the bearing point 31. The sensor facility 44 is connected actively to the control facility 25 with the aid of the sensor line 45.

An actuation element 46 is provided on the connecting element 42 or the block mechanism 33. The actuation element 46 is coupled to the handle 12 of the dish receptacle 10 by a transmission facility (described below) in such a manner that a movement of the handle 12 resulting from the actuation force $F_{x1}$, $F_{x2}$ is converted to a movement of the actuation element 46. The movement of the actuation element 46 can be rotational or, as shown in FIG. 5 with the aid of an arrow 47, linear. The actuation element 46 is a magnetic element, in particular a permanent magnet. The sensor facility 44 thus serves to detect the actuation force $F_{x1}$, $F_{x2}$. The control facility 25 activates the drive facility 24 as a function of the linear movement of the actuation element 46 detected by the sensor facility 44 in order to lower or raise the dish receptacle 10. The supporting force here can be proportional, preferably directly proportional, to the path traveled by the actuation element 46.

The actuation element 46 only interacts with the sensor facility 44 when the block mechanism 33 is in the block counter-mechanism 34. As the dish receptacle 10 is raised and lowered, the block mechanism 33 and the block counter-mechanism 34 only twist in relation to one another. Linear movement of the block mechanism 33 in relation to the block counter-mechanism 34 is not possible when the latter is in the blocking state. This ensures that the actuation element 46 can activate the sensor facility 44 during the entire raising and lowering movement of the dish receptacle 10. On the other hand, when the dish receptacle 10 is moved into the wash container 2 in the start position $P_A$ and the block mechanism 33 is not engaged with the block counter-mechanism 34, it ensures that the actuation element 46 does not activate the sensor facility 44. This means that the drive facility 24 cannot be activated when the dish receptacle 10 is in the pushed in state. This prevents damage to the dishes or the dish receptacle 10 due to unwanted activation of the drive facility 24. In embodiments of the lifting device 17 that are not shown the sensor facility 44 is not provided on the drag lever 30 but for example inside or outside the wash container 2. The actuation element 46 can be dispensable, depending on the type of sensor facility 44.

Returning to FIGS. 1 and 2 again, the lifting device 17 also comprises a transmission facility 48, as mentioned above, which is shown in a highly simplified manner in FIGS. 1 and 2. The transmission facility 48 transmits the actuation force $F_{x1}$, $F_{x2}$ mechanically or fluidically from the handle 12 to the sensor facility 44. Transmission can take place, as described above with reference to FIGS. 5 and 6, with the aid of the actuation element 46, which is coupled mechanically to the transmission facility 48. The transmission facility 48 can be or comprise a fluid line, a control cable, a Bowden cable, a bar, a gear mechanism or the like. As shown in FIGS. 1 and 2, the transmission facility 48 can be a Bowden cable for example, passed from the handle 12 to the bearing point 32 of the drag lever 30. The movement of the handle 12 is detected at the bearing point 32 with the aid of the sensor facility 44 and a corresponding signal is supplied to the control facility 25 with the aid of the sensor line 45. Because the handle 12 is coupled mechanically to the sensor facility 44 provided at the bearing point 32, there is no need for an electric cable or an energy storage unit on the dish receptacle 10 itself. There is also no need for complex signal transmission by radio.

As the conversion of the movement of the handle 12 to the sensor signal takes place in or at the bearing point 32, there is no need for length compensation on the sensor line 45 or at the transmission facility 48 as the dish receptacle 10 is raised or lowered.

In an alternative embodiment (not shown) of the lifting device 17 the transmission facility 48 is passed out of the wash container 2 through the bearing point 31 along the dish receptacle 10 and the drag lever 30, the sensor facility 44 then being arranged outside the wash container 2. The sensor facility 44 can then be embodied for example as a variable resistor. Additional mechanical locking of the handle 12 and/or the transmission facility 48 can also be provided, for example in the manner of a child-proof lock. The movement of the handle 12 can also be transmitted to the sensor facility 44 by movement of a frame of the dish receptacle 10 in relation to a base of the same.

The functionality of the lifting device 17 is described below with reference to FIGS. 1 to 6. To move the dish receptacle 10 from the start position $P_A$ shown in FIG. 1 to the end position $P_E$ shown in FIG. 2 a manual actuation force $F_{x1}$, in particular a tensile force, is applied to the dish receptacle 10 when it is still in the wash container 2. For example the user pulls the handle 12. This initially moves the dish receptacle 10 out of the dish receptacle 10 along the guide facility 13 in the pull-out direction A. As the block mechanism 33 is not yet engaged with the block counter-mechanism 34, the sensor facility 44 cannot yet be activated, so the drive facility 24 is deactivated as the dish receptacle 10 is pulled out of the wash container 2. As the dish receptacle 10 is pulled out, the block mechanism 33 becomes trapped in the block counter-mechanism 34 provided on the drag lever 30, so the sensor facility 44 can only be activated when the dish receptacle 10 has been pulled out of the wash container 2 completely. The sensor facility 44 can then detect the actuation force $F_{x1}$ and the control facility 25 can activate the drive facility 24 to apply the supporting force.

The control facility 25 can activate the drive facility 24 in such a manner that a movement speed of the dish receptacle 10 is proportional, preferably directly proportional, to the manual actuation force $F_{x1}$. The lifting device 17 now raises the dish receptacle 10 from the start position $P_A$ in the direction of the end position $P_E$. In this process the control facility 25 can activate the drive facility 24 in such a manner that the drive facility 24 is deactivated as soon as the manual actuation force $F_{x1}$ stops acting on the handle 12. The lifting device 17 preferably has a brake or stop facility, which stops the dish receptacle 10 in its current position, so that it does not move back into the start position $P_A$ due to its own weight or the weight of the dishes in the dish receptacle 10. As the dish receptacle 10 is raised from the start position $P_A$ to the end position $P_E$, the block mechanism 33 and the block counter-mechanism 34 help to prevent the dish receptacle 10 moving back along the guide facility 13 into the wash container 2. In particular the movement of the dish receptacle 10, as it is raised from the start position $P_A$ to the end position $P_E$, is guided with the aid of the drag lever 30. The drag lever 30 can pull the dish receptacle 10 back into the wash container 2 slightly as it is raised.

Conversely, to lower the dish receptacle 10 from the end position $P_E$ to the start position $P_A$, a manual actuation force $F_{x2}$ is applied to the dish receptacle 10. The force $F_{x2}$ is a compressive force applied to the handle 12 of the dish receptacle 10. The sensor facility 44 determines the actuation force $F_{x2}$ and the drive facility 24 is activated with the aid of the control facility 25 in such a manner that the drive facility 24 assists the movement of the dish receptacle 10 back from the end position $P_E$ to the start position $P_A$ with a supporting force. As soon as the dish receptacle 10 is back in the start position $P_A$, the block mechanism 33 can move out of the block counter-mechanism 34 so that the dish receptacle 10 can move back into the wash container 2 in the push-in direction E. As soon as the block mechanism 33 moves out of the block counter-mechanism 34, the sensor facility 44 is deactivated again, as the actuation element 46 is a distance away from the sensor facility 44.

Although the present invention has been described with reference to exemplary embodiments, it can be modified in many different ways.

The invention claimed is:

1. A lifting device for a dish receptacle of a dishwasher, said lifting device comprising:

a drive facility configured to assist a manual raising or lowering of the dish receptacle between a start position and an end position by applying a supporting force, a control facility configured to activate the drive facility as a function of a manual actuation force when the dish receptacle is raised or lowered manually, a sensor facility configured to detect the manual actuation force, and a transmission facility configured to transmit the manual actuation force from a handle of the dish receptacle to the sensor facility, wherein the transmission facility comprises a mechanical transmission member including a control cable, thereby to mechanically couple the handle of the dish receptacle to the sensor facility, wherein the control cable is directly coupled to the handle of the dish receptacle, and wherein the sensor facility is configured to detect a movement of the handle as the handle is acted upon by the manual actuation force.

2. The lifting device of claim 1, wherein the sensor facility is arranged inside a wash container of the dishwasher.

3. The lifting device of claim 1, wherein the control facility activates the drive facility in such a manner that a movement speed of the dish receptacle is proportional to the manual actuation force and/or the supporting force is proportional to the manual actuation force.

4. The lifting device of claim 1, wherein the movement speed and/or the supporting force is/are directly proportional to the manual actuation force.

5. The lifting device of claim 1, further comprising a drag lever having a bearing point for support on the dish receptacle, said drag lever configured to stop the dish receptacle as it is raised or lowered by fixing the dish receptacle to the drag lever in such a manner that the bearing point of the drag lever is pivotable in relation to the dish receptacle and immobile linearly.

6. The lifting device of claim 5, wherein the drag lever has a further bearing point for support on a wash container of the dishwasher, a sensor line of the sensor facility being dimensioned such as to extend out of the wash container through the further bearing point of the drag lever.

7. The lifting device of claim 5, wherein the sensor facility is provided in or on the bearing point of the drag lever.

8. The lifting device of claim 5, wherein the sensor facility is provided on the drag lever and includes an actuation element arranged on the dish receptacle.

9. The lifting device of claim 8, wherein the actuation element is a magnetic element.

10. The lifting device of claim 5, wherein the bearing point of the drag lever includes a block mechanism which is provided on the dish receptacle, and a block counter-mechanism which is provided on the drag lever.

11. The lifting device of claim 10, wherein the block mechanism and the block counter-mechanism are rotatable into one another, when the dish receptacle is moved out of a wash container linearly in the start position.

12. The lifting device of claim 11, wherein the block mechanism and the block counter-mechanism are movable from a release state, in which the dish receptacle is movable linearly in relation to the drag lever, to a blocking state, in which the bearing point of the drag lever is pivotable in relation to the dish receptacle and immobile linearly.

13. The lifting device of claim 12, wherein the block mechanism and the block counter-mechanism are movable from the release state to the blocking state by raising the dish receptacle.

14. The lifting device of claim 1, wherein the dishwasher comprises a household dishwasher.

15. A dishwasher, comprising:

a wash container, a dish receptacle accommodated in the wash container and including a handle, and a lifting device comprising a drive facility configured to assist a manual raising or lowering of the dish receptacle between a start position and an end position by applying a supporting force, a control facility configured to activate the drive facility as a function of a manual actuation force when the dish receptacle is raised or lowered manually, a sensor facility configured to detect the manual actuation force, and a transmission facility configured to transmit the manual actuation force from the handle of the dish receptacle to the sensor facility, wherein the transmission facility comprises a mechanical transmission member including a control cable, thereby to mechanically couple the handle of the dish receptacle to the sensor facility, wherein the control cable is directly coupled to the handle of the dish receptacle, and wherein the sensor facility is configured to detect a movement of the handle as the handle is acted upon by the manual actuation force.

16. The dishwasher of claim 15, wherein the dishwasher comprises a household dishwasher.

17. A lifting device for a dish receptacle of a dishwasher, said lifting device comprising:

a drive facility configured to assist a manual raising or lowering of the dish receptacle between a start position and an end position by applying a supporting force, a control facility configured to activate the drive facility as a function of a manual actuation force when the dish receptacle is raised or lowered manually, a sensor facility configured to detect the manual actuation force, and a transmission facility configured to transmit the manual actuation force from a handle of the dish receptacle to the sensor facility, wherein the transmission facility comprises a mechanical transmission member, thereby to mechanically couple the handle of the dish receptacle to the sensor facility, further comprising a drag lever having a bearing point for support on the dish receptacle, said drag lever configured to stop the dish receptacle as it is raised or lowered by fixing the dish receptacle to the drag lever in such a manner that the bearing point of the drag lever is pivotable in relation to the dish receptacle and immobile linearly, wherein the bearing point of the drag lever includes a block mechanism which is provided on the dish receptacle, and a block counter-mechanism which is provided on the drag lever, wherein the block mechanism and the block counter-mechanism are rotatable into one another, when the dish receptacle is moved out of a wash container linearly in the start position, and wherein the block mechanism and the block counter-mechanism are movable from a release state, in which the dish receptacle is movable linearly in relation to the drag lever, to a blocking state, in which the bearing point of the drag lever is pivotable in relation to the dish receptacle and immobile linearly.

* * * * *